US006155619A

United States Patent [19]

Kirkpatrick et al.

[11] Patent Number: 6,155,619

[45] Date of Patent: Dec. 5, 2000

[54] GRAPPLE HAVING ONE OR MORE TINES THAT INCLUDE A MAGNET

[75] Inventors: Jay A. Kirkpatrick, 9302 Lakeland Dr., Richmond, Va. 23229; John C. Droogsma, Midlothian, Va.

[73] Assignee: Jay A. Kirkpatrick, Richmond, Va.

[21] Appl. No.: 09/244,123

[22] Filed: Feb. 4, 1999

[51] Int. Cl.[7] ..... B66C 1/04; B66C 3/04

[52] U.S. Cl. ..... 294/3; 294/65.5; 414/606

[58] Field of Search ..... 294/2, 3, 24, 65.5, 294/68.23, 82.32, 88; 37/186, 187, 403, 406, 461; 335/285, 289, 291, 294; 414/606, 737

[56] References Cited

U.S. PATENT DOCUMENTS

| | | | |
|---|---|---|---|
| 2,515,292 | 7/1950 | Carr | 294/65.5 |
| 2,651,538 | 9/1953 | Stahmer . | |
| 2,850,189 | 9/1958 | Leroy . | |
| 3,040,921 | 6/1962 | Davis . | |
| 3,146,015 | 8/1964 | Roberge | 294/65.5 X |
| 3,596,967 | 8/1971 | Carter . | |
| 4,715,631 | 12/1987 | Nakajima . | |
| 5,299,845 | 4/1994 | Gabriel | 294/2 |
| 5,762,388 | 6/1998 | Futa . | |

FOREIGN PATENT DOCUMENTS

| | | |
|---|---|---|
| 25 09 003 | 9/1976 | Germany . |

*Primary Examiner*—Johnny D. Cherry
*Attorney, Agent, or Firm*—Oliff & Berridge, PLC

[57] ABSTRACT

An electromagnet is attached to the outer surface of at least one of the tines of a grapple. Preferably, the electromagnet is attached near the free end of the tine so that the bottom surface of the electromagnet, which extends between the inner and outer poles of the electromagnet, faces downward when the grapple is in the closed position. Preferably, the electromagnet is attached to the tine so that the bottom surface of the electromagnet is at or very close to the lowest point of the grapple when the grapple is in the closed position. It is also possible to attach respective electromagnets to any one of the plurality of tines, such that more than one of the plurality of tines has an electromagnet attached thereto.

19 Claims, 6 Drawing Sheets

GRAPPLE HAVING ONE OR MORE TINES THAT INCLUDE A MAGNET

BACKGROUND OF THE INVENTION

1. Field of Invention

The present invention relates to grapples, and in particular to grapples that include a magnet to assist in lifting scrap.

2. Description of Related Art

As is well known in the art, grapples are used to gather and move material, such as scrap metal, from one location to another. For example, grapples are commonly used to load and/or unload scrap metal from vehicles such as trucks and freight cars (i.e., attached to locomotives). Such grapples include a plurality of tines, also referred to as arms, that are movable to grasp and release material. Typically, a grapple includes 3, 4 or 5 tines, although other designs are possible and known.

Grapples are used to move material of various shapes and sizes. One problem that arises is the inability of the grapple to grasp smaller pieces of scrap. It is desirable to completely empty all scrap from the bed of a transport vehicle (a truck or a train car) so that each load can be maximized. Thus, it is necessary to sweep the cargo area (or the ground) with a magnet in order to clear the area of the remaining scrap that could not be easily grasped by the tines. There are a number of known techniques for sweeping an area with a magnet after using the grapple.

A first technique uses a separate lifting magnet (an electromagnet) in order to clear remaining scrap from an area. For example, the grapple is removed from the crane that was using the grapple, and is replaced with a separate lifting magnet. Swapping the grapple for the separate magnet is time-consuming and requires the user to purchase a separate lifting magnet. A less time-consuming approach is to provide a harness for the lifting magnet, and to lift the lifting magnet by grasping the harness with the grapple. However, considerable time is still required in order to make the electrical connection of the magnet to the crane, and to properly grasp the harness. Additionally, a separate lifting magnet is still required. It is cumbersome for a crane operator to transport a grapple and lifting magnet form location to location.

Thus, another approach is to include an electromagnet in the grapple. Examples of combined lifting magnets and grapples are shown in U.S. Pat. No. 2,850,189, U.S. Pat. No. 4,715,631 and U.S. Pat. No. 5,762,388. All three of these patents disclose a design in which an electromagnet is provided inside the grapple. Although helpful in picking-up scrap, particularly smaller pieces of scrap, designs in which an electromagnet is provided inside the grapple tend to reduce the volume of material that can be held within the grapple at one time. Additionally, these designs require that the grapple be placed in its fully open position so that the electromagnet can be located close to the ground. (See, for example, FIG. 1 of U.S. Pat. No. 2,850,189.) This is cumbersome, and makes it difficult to reach scrap that is located in corners, for example, in the corner of a truck bed or a freight car that is being unloaded. Alternatively, as illustrated in U.S. Pat. No. 4,715,631, the grapple is specially designed so that the tines can be retracted to a position above the electromagnet. This, however, increases the cost of the grapple, and makes it more mechanically complicated and subject to breakdown.

The above-referenced U.S. Pat. No. 5,762,388 also discloses winding a magnetic coil around a central portion of a tine. See FIGS. 4 and 5, and col. 3, line 60-col. 4, line 30. According to U.S. Pat. No. 5,7652,388, when current is passed through the coil, the tine becomes magnetized, and a magnetic field is generated within the area defined by the tines. This design is not practical because it will cause the bushings to become magnetized, which obviously is not desirable since debris will collect in the area of the bushings, damaging them. U.S. Pat. No. 5,762,388 is concerned with reducing the amount of material that falls from the tines, rather than using the grapple or the tines to sweep an area of scrap that could not be grasped by the tines. It is believed that none of the tines of this device would be sufficiently magnetized to enable them to be used to effectively sweep an area of scrap because an insufficient amount of magnetic pull would be generated at the lowermost portion of the tine.

Thus, there is a need for an improved grapple that is capable of using an electromagnet to effectively sweep an area of scrap that could not be, or was not, grasped by the grapple.

SUMMARY OF THE INVENTION

In order to address the above and other deficiencies, according to the present invention, an electromagnet is attached to the outer surface of at least one of the tines of a grapple. Preferably, the electromagnet is attached near the free end of the tine so that the bottom surface of the electromagnet, which extends between the inner and outer poles of the electromagnet, faces downward when the grapple is in the closed position. Preferably, the electromagnet is attached to the tine so that the bottom surface of the electromagnet is at or very close to the lowest point of the grapple when the grapple is in the closed position.

Thus, the electromagnet can be used to sweep an area of scrap metal by simply closing the grapple and moving the grapple over the area to be swept. Since the magnet is not located within the chamber defined by the tines of the grapple, the magnet does not reduce the volume of the chamber in any way. Additionally, the magnet can be relatively small compared to the electromagnets that are provided inside grapples on the lower portion of the central body to which the tines are pivotally attached.

Although it is possible, and certainly within the scope of the present invention, to provide electromagnets on more than one of the tines, it has been found that the provision of a single electromagnet on one of the tines is more than sufficient. Thus, compared to grapples having an electromagnet within the chamber defined by the tines, a grapple made with a single electromagnet on one of the tines, as described above, has a reduced weight.

One aspect of the invention relates to a grapple tine having an electromagnet attached thereto. For example, the grapple tine includes an elongated, curved metal tine housing having first and second opposite ends, a radially inner curved surface, and a radially outer curved surface. The first end of the tine housing includes at least a portion of a pivotal connector (for example, aligned holes that can be aligned with holes on a central body of the grapple, and attached to the central body with a pin). The second end of the tine housing includes a tooth that extends in a first direction. The electromagnet is attached to the radially outer curved surface of the tine housing. Preferably, the electromagnet is attached to the radially outer curved surface of the tine housing so that a bottom plate of the electromagnet extends in a plane that is substantially parallel to the first direction in which the tooth extends. More preferably, the bottom plate of the electromagnet is attached near the second end of the tine housing, adjacent to the lowermost portion of the tine housing.

Another aspect of the invention relates to a grapple having a central body, a plurality of tines pivotally attached to the central body, and an electromagnet. The plurality of tines are pivotal between an open position and a closed position. The plurality of tines define a chamber therebetween. Each of the plurality of tines has an inner surface that faces the chamber and an outer surface that faces away from the chamber. The outer surface also faces in a direction opposite from a direction in which the inner surface faces. The electromagnet is attached to the outer surface of one of the plurality of tines. Preferably, the electromagnet is attached adjacent to a portion of the tine that is located closest to the ground when the grapple is in the closed position. As noted above, it is also possible to attach respective electromagnets to respective ones of the plurality of tines, such that more than one of the plurality of tines has an electromagnet attached thereto.

Another aspect of the invention relates to a method of making a grapple tine in which an electromagnet is attached to an outer surface of the grapple tine. The method results in the construction of a grapple tine, and ultimately a grapple, having the features mentioned above.

BRIEF DESCRIPTION OF THE DRAWINGS

The invention will be described in conjunction with the following drawings in which like reference numerals designate like element, and wherein.

DETAILED DESCRIPTION OF PREFERRED EMBODIMENTS

Preferred embodiments of the invention are now described. These preferred embodiments are intended to be illustrative, not limiting. For example, while the illustrated grapple has four tines, the invention is applicable to grapples having any number of tines. An electromagnet can be provided on one or any number of, and possibly all, of the tines. When it is stated that an electromagnet is attached to one tine, it is intended to cover grapples in which electromagnets are attached to more than one of the tines, as well as grapples in which an electromagnet is attached to only one of the tines. That is, a grapple having electromagnets attached to a plurality of its tines also has an electromagnet attached to one of its tines.

In its most general aspect, the invention relate, to the provision of an electromagnet on at least one of the tines of a grapple. The primary use of the electromagnet is to enable scrap that was not removed with the normal grasping function of the grapple to be removed by magnetic attraction. The electromagnet is provided on the outer surface of the tine, and preferably is located near the free end of the tine. Accordingly, when the grapple is placed in the closed position (i.e., with the tines located in their lowermost position), the electromagnet is located near the lowest portion of the grapple. This enables the electromagnet to be swept very close to the surface (for example, the ground or the floor of the cargo area) from which scrap is being removed.

The electromagnet can be attached to the tine by welding. Preferably, additional hardware (e.g., metal plates) are used to attach the electromagnet to the outer surface of the tine and to prevent debris from lodging between the electromagnet and the tine, which could undesirably remove the electromagnet from the tine. The power supply cable for the electromagnet can be fed through the tine (which, except for reinforcing honeycomb structure, is hollow) and exits the tine at a location that is free from exposure to debris, for example, near the top of the tine.

Figure 1:
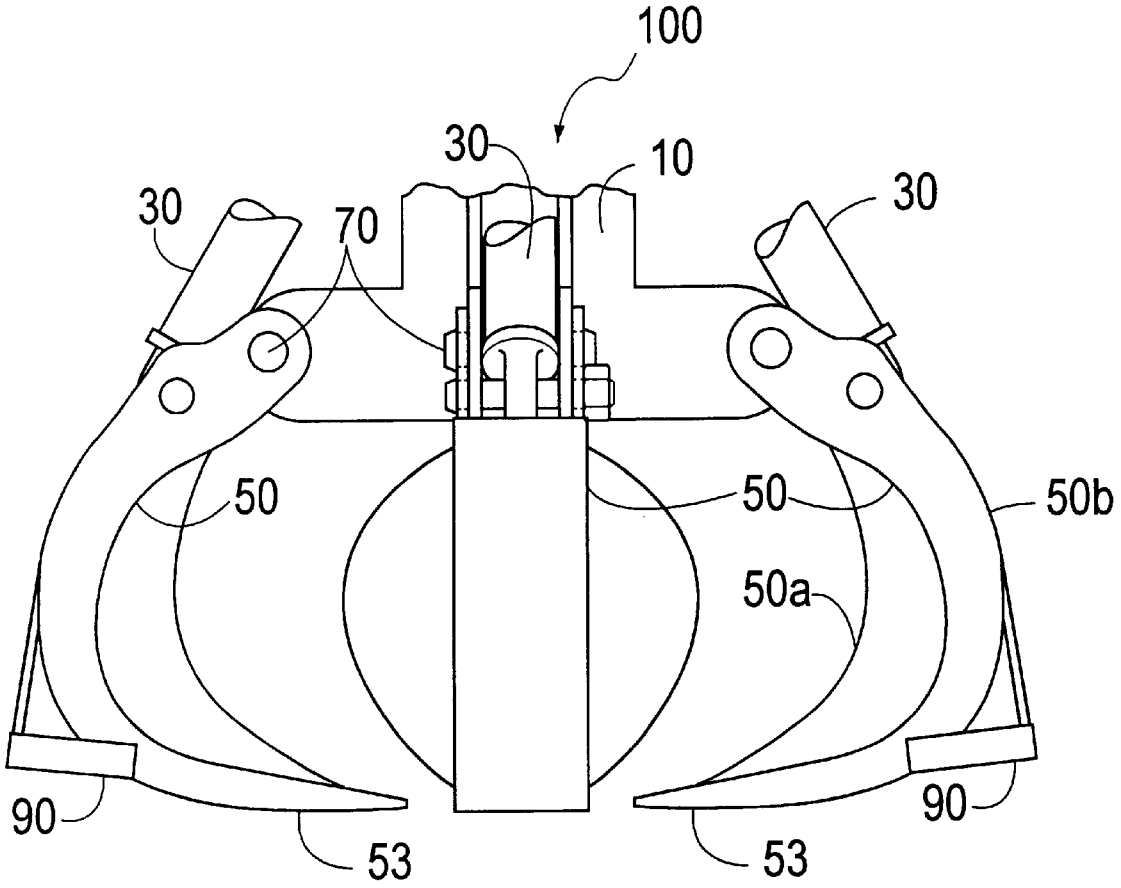
FIG. 1 is a side view of a grapple according to an embodiment of the invention, in which two of the grapple tines include electromagnets attached thereto.

FIG. 1 is a side view of a grapple 100 according to a first embodiment of the invention. The grapple 100 includes four tines 50 (only three tines are visible in FIG. 1). Two of the tines (the left and right tines in FIG. 1) each include an electromagnet 90 welded thereto.

Each of the tines is pivotally attached to a central body 10 of the grapple 100 by a pin 70 that extends through holes in a first end of the tines 50. The holes in the tines align with holes in the central body 10. Cylinders 30 are pivotally attached to each of the tines 50, and cause the tines to move up or down to place the grapple in the open position or the closed position, respectively.

The tines define a chamber between them. Scrap is held in this chamber when the grapple is moved from the open position to the closed position. Each of the tines includes an inner surface 50*a* that faces the chamber. Each of the tines includes an outer surface 50*b* that faces away from the chamber and faces in a direction opposite from a direction in which the inner surface 50*a* faces. The second end of each of the tines includes a tip 53. As is clear from FIG. 1, the electromagnets 90 are attached to the outer surface 50*b* of the tines near the tip 53 at the second end of the tines.

Figure 2:
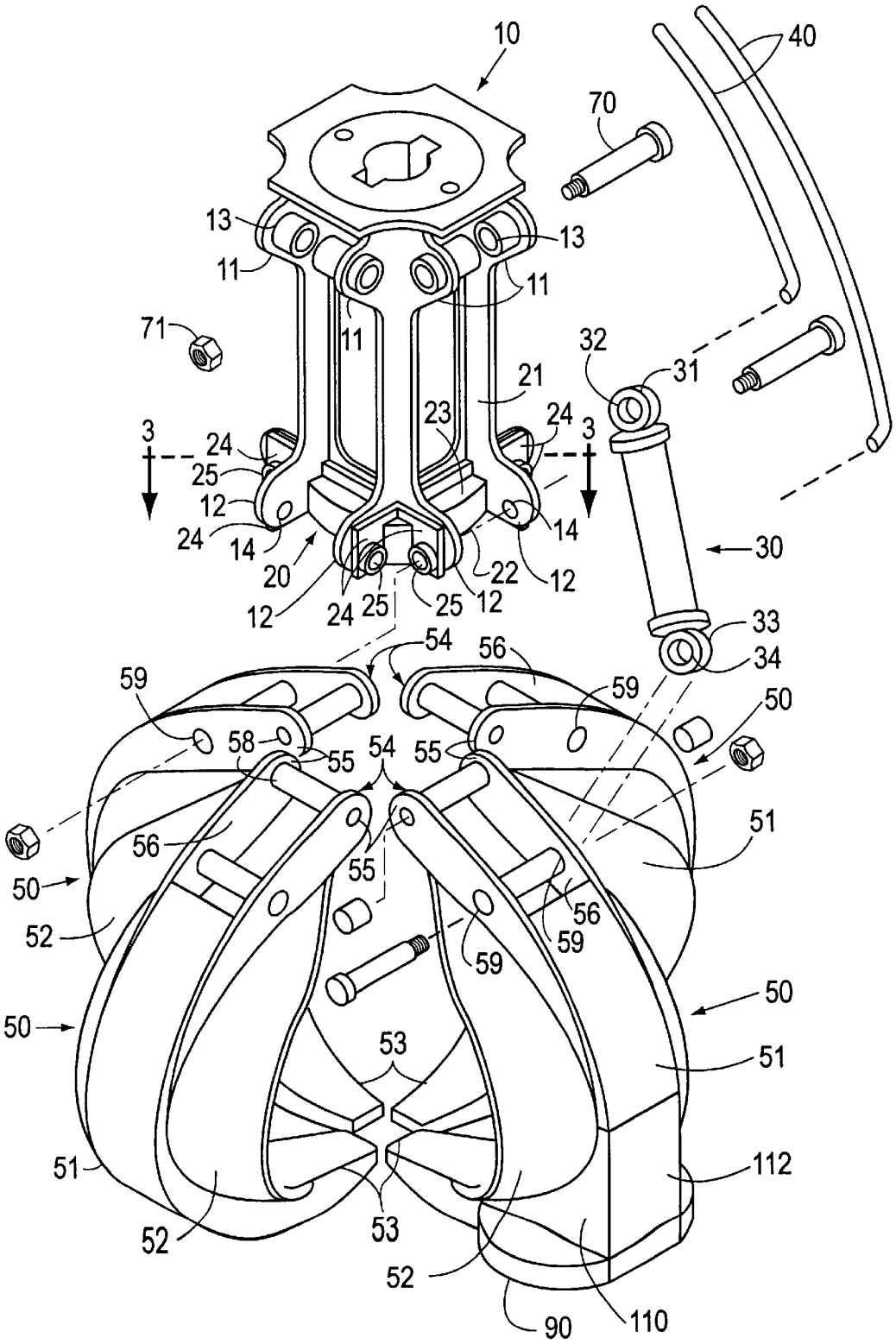
FIG. 2 is an exploded view of a grapple according to an embodiment of the prevent invention, in which an electromagnet is attached to one of the tines.

FIG. 2 is an exploded view of a grapple according to another embodiment of the present invention. The grapple generally includes a central body (or head assembly) 10, cylinders 30, hoses 40, a plurality of tines 50 and a magnet 90 on one of the tines 50.

Head assembly 10 includes a plurality of top ears 11 and bottom ears 12 spaced thereabout in pairs. Top ears 11 each include a hole 13 therethrough. Each bottom ear 12 includes a hole 14 therethrough. Top ears 11 and bottom ears 12 are used to secure cylinders 30 and tines 50, respectively, to head assembly 10 as described below.

A lower body 20 of head assembly 10 is generally located within the space defined by bottom ears 12 and includes a top surface 21, a bottom surface 22 and a continuous side surface 23. A plurality of ears 24 extend from body 20 and are arranged in pairs spaced evenly about body 20. One pair of ears 24 corresponds to each pair of bottom ears 12. Ears 24 each include a hole 25 therein. Holes 25 lie along the same axis as holes 14 in the corresponding pair of bottom ears 12.

Each cylinder 30 includes a top ear 31 having a hole 32 therein and a bottom ear 33 having a hole 34 therein. Top ear 31 is placed between a pair of corresponding top ears 11 on head assembly 10, and a bolt or pin 70 is inserted through holes 13 and 32 and secured with a nut 71. In this manner, one end of cylinder 30 is secured to head assembly 10. Although only one cylinder 30 is shown, four would be used for the grapple shown, one for each tine 50. Hoses 40 are connected at one end of cylinders 30 and at the other end to a source of hydraulic fluid, as is known in the art, to operate cylinders 30.

Each tine 50 is a generally curved member, including a main portion 51, a skin 52, a first end 54 and a second end 53. At first end 54, each tine is separated into two arms 55 separated by a slot 56. A hole 58 extends through each arm 55 at second end 54 of tines 50 and is in communication with slot 56. A second hole 59 extends through each tine 50 and is in communication with slot 56. Main portion 51 of tines 50 is preferably constructed from steel. Skin 52 also is constructed from steel. Additionally, a honeycomb reinforcement structure is provided within each tine 50 (within the hollow body defined by the skin 52 and the main portion 51).

Tines 50 are secured to head assembly 10 by positioning a pair of lower ears 12 within slot 56 in a tine 50 and inserting a bolt or pin 70 through holes 58 and 14 and securing with a nut 71. Bottom ear 33 of a cylinder 30 is inserted into slot 56 of tine 50, and secured thereto by inserting a bolt 70 through second holes 59 and hole 34 and securing with a nut 71.

When cylinders 30 are extended, bottom ears 33 will bear against the bolts or pins joining them to tines 50 and cause tines 50 to pivot inwardly (and downward) causing the grapple to move to the closed position. When cylinders 30 are retracted, top ears 31 will pull on bolts or pins 70 joining them to tines 50, thereby opening tines 50.

Figure 3:
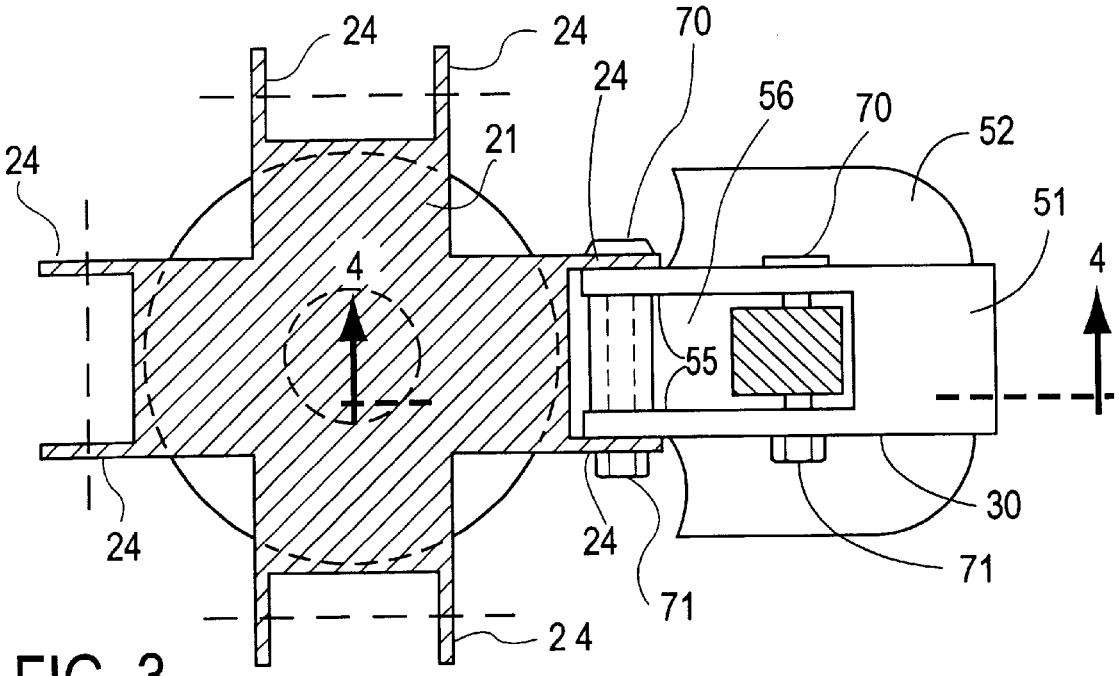
FIG. 3 is a cross-sectional view taken just above the top surface of the FIG. 2 electromagnet, with one tine secured thereto.

FIG. 3 is a cross-sectional view taken above top surface 21 of body 20 in FIG. 2, with one tine 50 secured thereto. FIG. 2 illustrates how ears 24 of body 20 straddle the outer surface of arms 55 of tines 50.

Figure 4:
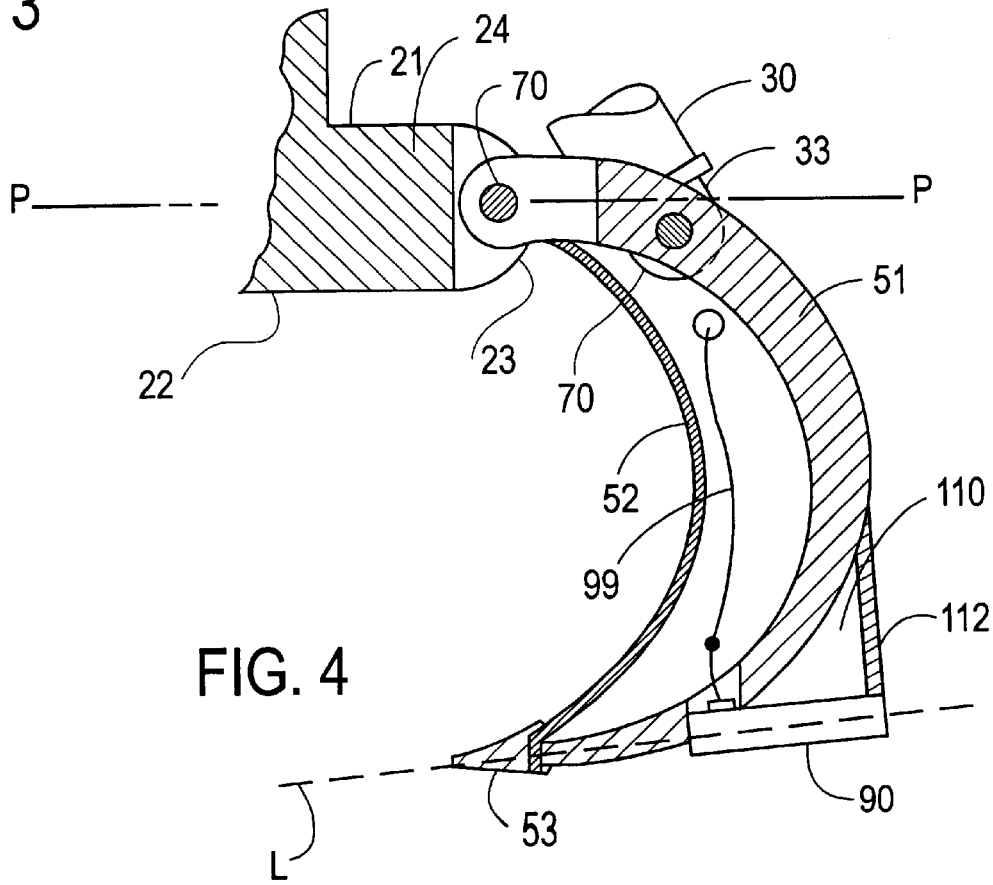
FIG. 4 is a cross-sectional view taken along line 4—4 of FIG. 3.

FIG. 4 is a cross-sectional view taken along line 4—4 in FIG. 3. In this view, it can be seen that each tine 50 includes a central portion 51 welded to skin 52.

As also shown in FIGS. 2 and 4, an electromagnet 90 is attached to one of the tines near second end 53. According to one embodiment, a section of main portion 51 of the tine is removed. One side of the electromagnet (which is a circular magnet) is welded to the section of main portion 51 that remains near the second end 53. The portion of main portion 51 that remains above the electromagnet is welded to the top of the electromagnet. Then, steel plates are welded between the upper surface of the electromagnet 90 and another section of the main portion 51 located above the upper surface of the magnet 90. In particular, two side plates 110 (only one of the side plates 110 is shown in FIG. 2) are welded between the upper surface of electromagnet 90 and the sides of main portion 51. A third plate 112 is welded between the upper surface of electromagnet 90 and the outer surface of main portion 51 located above the electromagnet. Edges of plate 112 are welded to the adjoining edges of plates 110. This form of attachment rigidly secures the electromagnet to the outer surface of the tine. It also maintains the integrity and strength of the tine. It also prevents debris (e.g., scrap) from lodging between the upper surface of the electromagnet and the tine, which could cause the electromagnet to be dislodged. The method by which an electromagnet is attached to a tine having a different structure is described below with respect to FIGS. 6A and 6B.

Figure 5:
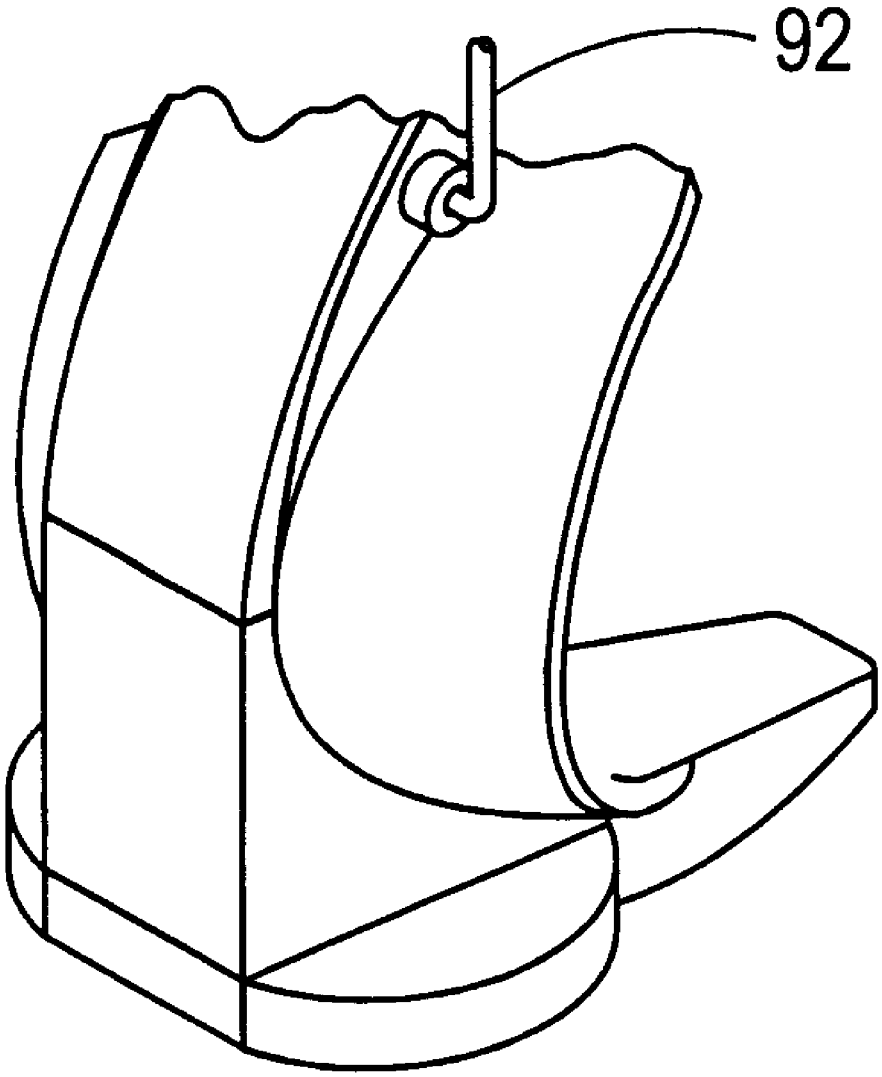
FIG. 5 is a perspective view of part of a tine having an electromagnet attached thereto.

As illustrated in FIG. 4, the power supply lines 99 of the electromagnet 90 can be fed through the interior of the tine, and exit through an upper portion of the main portion 51 of the tine (as illustrated in FIG. 5) and run as a cable 92 to the electric power supply of the crane to which the grapple is attached.

Figure 6A:
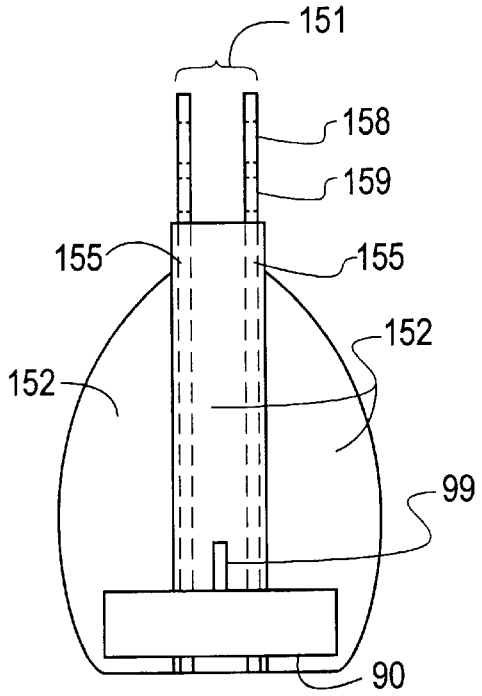
FIGS. 6A and 6B are an end view and a side view, respectively, of a tine, and illustrate how the electromagnet is attached to the existing tine structure.
Figure 6B:
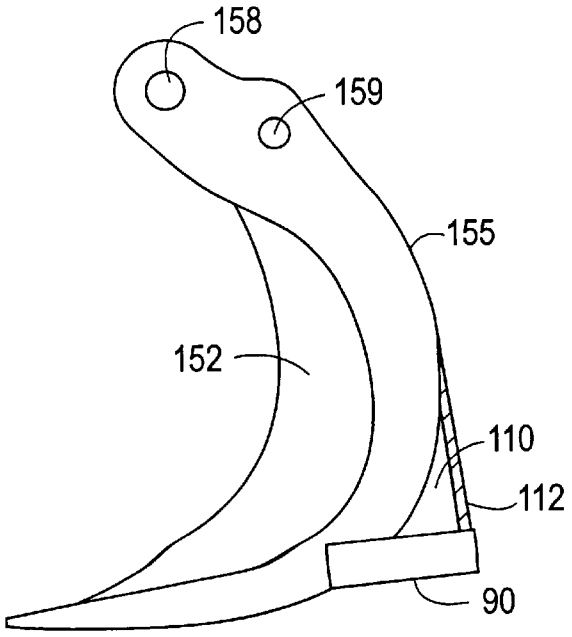

FIGS. 6A and 6B show a slightly different tine design, and the manner in which the electromagnet is attached thereto. In this design, as shown in FIG. 6A, the main portion 151 of the tine is formed by two identical steel plates 155, which also include holes 158 and 159 for attachment to the central body and hydraulic cylinders of the grapple. The skin 152 covers most of the steel plates 155 and also defines the remainder of the tine housing. A honeycomb structure is also provided within the tine housing to reinforce it. The plates 155, skin 152 and honeycomb structure are fabricated from ¼ inch or ⅜ inch steel. To attach an electromagnet 90 to this tine, 90° cuts are made in each plate 155, and the portion of the skin 152 between these plates is removed. The power supply lines 99 of the electromagnet are fed through the inside of the tine as described above. The side and top of the electromagnet are welded to the 90° cuts in the plates 155, and the plates 110 and 112 are welded between the top of the electromagnet and the tine as described earlier.

Figure 7:
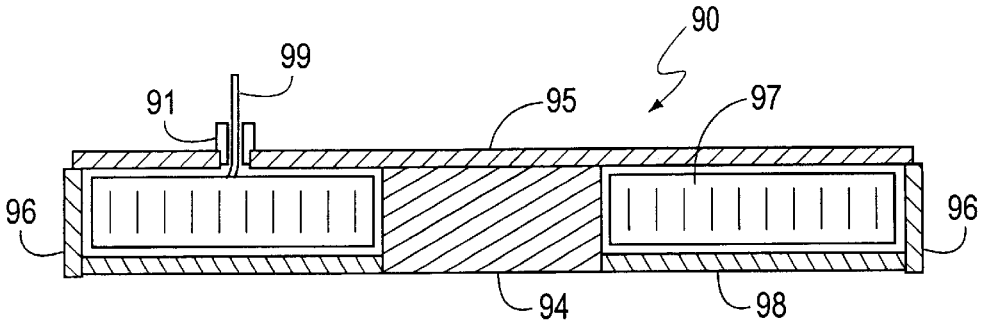
FIG. 7 is a cross-sectional view of an electromagnet according to an embodiment of the present invention.

FIG. 7 is a cross-sectional view of one electromagnet. The electromagnet includes a top plate 95. A central core 94 is welded to a lower surface of the top plate 95 at the center of the top plate 95. The central core 94 functions as the center pole of the magnet. A cylindrical side wall 96 is welded to the lower portion of the top plate 95 at the outer circumference of the top plate 95. The sidewall 96 functions as the outer pole of the magnet. An electric coil 97 is placed between the central core 94 and the cylindrical side wall 96. A circular bottom plate 98 having a central aperture through which the bottom of the central core 94 extends is then welded to the outer circumference of central core 94 and to the inner circumference of cylindrical side wall 96 to seal the electric coil 97 within the casing of the electromagnet 90. As illustrated in FIG. 7, a small hole is provided in the top plate 95. A fitting 91 is attached to this small hole, and the power supply line 599 of the electric coil 97 is passed through this hole and fitting 91.

An electromagnet 90 having the FIG. 7 design was constructed as follows. The electromagnet 90 had an outer diameter of 16 inches. The central core 94 had a diameter of 6 inches and was 3.5 inches high. The top plate 95 had a thickness of one-half inch, and a diameter of 15.5 inches. The cylindrical side wall 96 was one-half inch thick, 3.5 inches high, 51 inches long, and was rolled to have an inner diameter of 15 inches. The material used for the top plate 95, the central core 94 and the cylindrical side wall 96 was ASTM A36 steel. The bottom plate 98 was a stainless steel plate (304 stainless steel) having a thickness of ¼ inch, an outer diameter of 15 inches and an inner diameter of 6 inches. The electric coil 97 was formed by winding 100 pounds of round no. 16 magnet wire. The magnet wire can be coated with regular insulator or can be glass coated, such as double dacron wrapped glass wire. The wound wire was insulated with cotton, dipped in resin and baked as is well known in the art. The total coil resistance was 43.18 ohms when energized with 240 volts DC (=5.33 amps. cold). The diameter of the wire was selected so that a sufficient number of turns could be made within the alloted space to result in a magnet having sufficient pulling strength, without generating too much heat.

Interestingly, in a prototype, in which the above-described electromagnet was attached to a tine having a hollow housing with a honeycomb reinforcement structure therein as shown in FIGS. 6A and 6B, the center pole increased from 7 inches to 10 inches. In other words, prior to attachment to the tine, the electromagnet could lift test material located 7 inches below the center pole at the bottom surface of the electromagnet. However, after the electromagnet was attached to the tine as described above, the magnet could lift the same test material located 10 inches below the center pole at the bottom surface of the electromagnet. Additionally, the magnetic field produced by the magnet extended down to the tip 53 of the tine so as to have an effective diameter of 26 inches (rather than the 16 inch diameter of the magnet). However, the magnetic energy did not extend vertically up the tine. Although these features are not necessary for the device to function, they further improved the effectiveness of the combined grapple/electromagnet.

Figure 8:
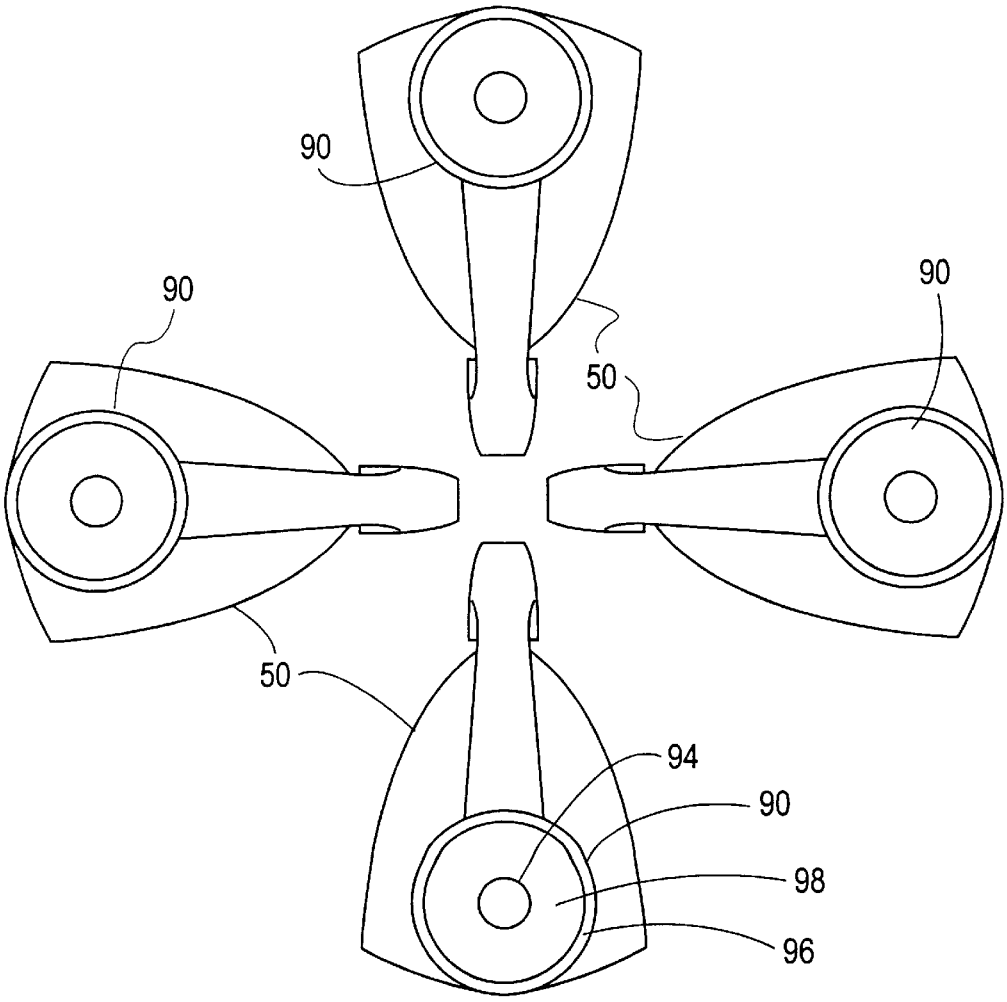
FIG. 8 is a bottom view of a grapple in the closed position, and having an electromagnet on each of its four tines.

FIG. 8 is a bottom view of a grapple having four tines, with an electromagnet provided on each of the tines.

The invention is not limited to the embodiments described above. The invention is applicable to grapples having any number of tines. Additionally, an electromagnet can be provided on only one of the tines; or on more than one, and possibly all of the tines. The electromagnet need not be circular, but can be other shapes such as oval, square, rectangular or triangular.

The invention is applicable to grapples having tines with designs that are different from those illustrated herein. If the tine is cut in order to attach the electromagnet, it may be desirable to further reinforce the tine so that its integrity is not compromised. This was not found to be necessary in the prototype tine of FIGS. 6A and 6B. Additionally, depending on the design of the tine, it may not be necessary to cut into the tine. The electromagnet would simply be welded to the outer surface of the tine.

In the illustrated embodiments, the magnet was attached to the tine(s) so that the bottom surface of the magnet extended in a direction (plane) that was parallel to the direction in which the tooth at the end of the tine extends (this direction is illustrated by line L in FIG. 4). When the grapple is of the type that places the teeth of the tines in a horizontal orientation when the grapple is closed, the bottom plate of the magnet also will be horizontal when the grapple is the closed position. The invention is applicable to all grapples, including grapples that do not place the teeth in the horizontal orientation when the grapple is closed. Similarly, the bottom plate of the magnet does not need to be perfectly horizontal when the grapple is in the closed position. For example, the prototype was effective even though the bottom plate of the magnet was oriented at approximately 40° when the grapple was placed in the closed position. The bottom plate of the magnet does not need to extend parallel to the direction in which the tine tooth extends. This is particularly true when the tine tooth is not oriented horizontally when the grapple is placed in the closed position.

The magnet preferably should be located so that it is on the outer surface of the tine, near the free end of the tine.

While the present invention has been described with reference to preferred embodiments thereof, it is to be understood that the invention is not limited to the disclosed embodiments or constructions. To the contrary, the invention is intended to cover various modifications and equivalent arrangements. In addition, while the various elements of the disclosed invention are shown in various combinations and configurations, which are exemplary, other combinations and configurations, including more, less or only a single element, are also within the spirit and scope of the invention.

What is claimed is:

1. A grapple tine comprising:

an elongated, curved metal tine housing having first and second opposite ends, a radially innermost curved surface and a radially outermost curved surface;

the first end of the tine housing including at least a portion of a pivotal connector;

the second end of the tine housing having a tooth; and an electromagnet attached to the radially outermost curved surface of the tine housing, the electromagnet including a winding, the winding of the electromagnet is located radially outward of the outermost curved surface and is not located radially inward of the innermost curved surface.

2. The grapple tine of claim 1, wherein the electromagnet is attached to the radially curved outermost surface of the tine housing near the second end of the tine housing.

3. The grapple tine of claim 1, wherein the tine housing extends in a longitudinal direction between the first end and the second end, and a bottom plate of the electromagnet extends substantially perpendicular to the longitudinal direction.

4. The grapple tine of claim 1, wherein the tooth extends in a first direction, and the electromagnet includes a bottom plate that extends in a plane that is substantially parallel to the first direction in which the tooth extends.

5. The grapple tine of claim 1, wherein:

the electromagnet includes a magnet housing;

the magnet housing is defined by a center pole, an outer side wall, a top plate and a bottom plate;

the winding is located in the magnet housing between the center pole and the side wall and between the top plate and the bottom plate; and a portion of the magnet housing is attached to the tine housing.

6. A method of making the grapple tine of claim 1, comprising the step of attaching the electromagnet to the radially outermost curved surface of the tine housing.

7. The method of claim 6, wherein the attaching step is performed by welding.

8. A grapple comprising:

a central body;

a plurality of tines pivotally attached to the central body, the plurality of tines being pivotal between an open position and a closed position, the plurality of tines defining a chamber therebetween, each of the plurality of tines having an innermost surface that faces the chamber, each of the plurality of tines having an outermost surface that faces away from the chamber and faces in a direction opposite from a direction in which the innermost surface faces; and an electromagnet attached to the outermost surface of one of the plurality of tines, the electromagnet including a winding, the winding of the electromagnet is located radially outward of the outermost curved surface and, is not located within the chamber.

9. The grapple of claim 8, wherein each of the plurality of tines includes a first end pivotally attached to the central body, and a second, free end opposite from the first end, and the electromagnet is attached to the outermost surface adjacent to the second end of the one tine.

10. The grapple of claim 8, wherein the electromagnet includes a center pole, a side wall, a winding located between the center pole and the side wall, and the bottom plate extending between the center pole and the side wall;

and the bottom plate extends substantially horizontal when the grapple is in the closed position.

11. The grapple of claim 8, wherein each of the plurality of tines includes:

an elongated, curved metal tine housing having first and second opposite ends;

the first end of the tine housing being pivotally connected to the central body;

the second end of the tine housing having a tooth that extends in a first direction; and wherein:

the electromagnet is attached to the outermost surface of the tine housing of the one tine so that a bottom plate of the electromagnet extends in a plane that is substantially parallel to the first direction in which the tooth of the one tine extends.

12. The grapple of claim 8, wherein at least two of the plurality of tines have an electromagnet attached thereto.

13. The grapple of claim 8, wherein:

the electromagnet includes a magnet housing;

the magnet housing is defined by a center pole, an outer side wall, a top plate and a bottom plate;

the winding is located in the magnet housing between the center pole and the side wall and between the top plate and the bottom plate; and a portion of the magnet housing is attached to the outermost surface of the one tine.

14. A method of making the grapple of claim 8, comprising the step of attaching the electromagnet to the outer surface of the one tine.

15. A method of claim 14, wherein the attaching step is performed by welding.

16. A grapple comprising:

a central body;

a plurality of tines pivotally attached to the central body, the plurality of tines being pivotal between an open position and a closed position and defining a chamber therebetween, each of the plurality of tines having an innermost surface that faces the chamber and an outermost surface that faces away from the chamber and faces in a direction opposite from a direction in which the innermost surface faces, each of the plurality of tines having a first end that is pivotally attached to the central body, each of the plurality of tines having a second, free end opposite the first end, the second ends of the plurality of tines being a lowermost portion of the grapple when the grapple is in the closed position; and at least one of the plurality of tines having an electromagnet attached only to the outermost surface of the at least one tine adjacent to the second end of the at least one tine so that the electromagnet is adjacent to the lowermost portion of the grapple when the grapple is in the closed position.

17. The grapple of claim 16, wherein at least two of the plurality of tines have an electromagnet attached thereto.

18. The grapple of claim 16, wherein:

the electromagnet includes a magnet housing and a winding;

the magnet housing is defined by a center pole, an outer side wall, a top plate and a bottom plate;

the winding is located in the magnet housing between the center pole and the side wall and between the top plate and the bottom plate; and a portion of the magnet housing is attached to the outermost surface of the at least one tine, wherein the winding of the electromagnet is not located in the chamber.

19. A method of making the grapple of claim 16, comprising the step of attaching the electromagnet to the at least one tine.

* * * * *